United States Patent [19]

Kostylev et al.

[11] Patent Number: 4,629,008

[45] Date of Patent: Dec. 16, 1986

[54] REVERSIBLE PERCUSSIVE ACTION MACHINE

[75] Inventors: Alexandr D. Kostylev; Vladimir D. Plavskikh; Alexei D. Terskov; Nikolai P. Chepurnoi, all of Novosibirsk; Mikhail J. Bondar, Odessa; Igor I. Reznikov, Odessa; Vladimir I. Tarasenko, Odessa, all of U.S.S.R.

[73] Assignee: Institut Gornogo Dela Sibirskogo Otdelenia Akademii Nauk SSSR, Novosibirsk, U.S.S.R.

[21] Appl. No.: 617,394

[22] Filed: Jun. 5, 1984

[30] Foreign Application Priority Data

Aug. 16, 1983 [SU] U.S.S.R. ..... 3596851

[51] Int. Cl.[4] ..... E21B 11/02

[52] U.S. Cl. ..... 173/91; 175/19

[58] Field of Search ..... 173/91, 112, 116; 91/337; 251/297, 319, 73, 94; 137/505 T, 455 T; 175/19

[56] References Cited

U.S. PATENT DOCUMENTS

| | | | |
|---|---|---|---|
| 2,729,228 | 1/1956 | Stevenson | 137/506 |
| 3,744,576 | 7/1973 | Sudnishnikov et al. | 173/91 |
| 4,078,619 | 3/1978 | Sudnishnikov et al. | 173/91 |
| 4,370,102 | 1/1983 | Sasaki et al. | 137/506 |

FOREIGN PATENT DOCUMENTS

| | | |
|---|---|---|
| 2340751 | 9/1974 | Fed. Rep. of Germany . |
| 2633251 | 12/1980 | Fed. Rep. of Germany . |

*Primary Examiner*—Donald R. Schran
*Assistant Examiner*—James L. Wolfe
*Attorney, Agent, or Firm*—Lilling & Greenspan

[57] ABSTRACT

A reversible percussive action machine comprises a housing which accommodates a hammer capable of reciprocating motions under the action of a pressurized fluid, and a fluid valving member for controlling the distribution of fluid with parts for fixing it in two fluid control positions to assure either the forward or rearward percussive action of the machine. To fix the fluid valving member to provide for the forward percussive action of the machine, a spring-loaded insert which is movably secured relative to the valving member and engageable with a stop made in the housing is used. To fix the fluid valving member in a position to provide for the rearward percussive action of the machine, a stop made on the inside wall of the housing and a stop made in the valving member to engage with the stop of the housing is used. The insert is fashioned as a cup accommodating an element imparting a spring action on the cup relative to the fluid valving member.

4 Claims, 6 Drawing Figures

REVERSIBLE PERCUSSIVE ACTION MACHINE

FIELD OF THE INVENTION

This invention relates to construction machinery and, more particularly, to reversible percussive action machines.

The machine according to the invention is intended predominantly for making holes and wells during laying underground communications without digging trenches.

In addition, the proposed machine can be used as an impact delivering unit for driving into the ground casings and piles, as well as for taking soil samples in geological explorations.

An ever increasing employment of reversible percussive action machines, particularly for making a multitude of short-length blind holes during erecting piles or geological explorations called for improvements in the reliability of such machines, and more specifically required that the means for reversing the action of these machines would be capable of fast response to the reverse signal preferably to be applied by pulling axially a flexible hose or pipe connected to the machine. These requirements account for the development of a range of improved constructions of percussive action machines.

BACKGROUND OF THE INVENTION

There is known a reversible percussive action machine (cf. West German Pat. No. 2,340,751, published Aug. 11, 1973) comprising a housing accomodating a hammer capable of reciprocations under the action of a fluid under pressure, and a system for valving or distributing the fluid to assure that the hammer delivers impacts either on the front or head end, or on the rear or tail end of the housing to provide either for a forward travel of the machine or for backing up, respectively.

The distribution of the fluid under pressure both for the forward and rearward percussive actions of the machine is controlled by a fluid valving member connected movably to the hammer.

The fluid valving member may be fixed in place relative to the housing either in front or rear positions; in the front position the valving member controls the passage of the fluid to assure the forward percussive action, while in the rear position it controls the fluid distribution for the rearward percussive action of the machine.

The fluid valving member is connected to the housing through a pipe joined to a flange element. The flange is rigidly secured in the housing, and the fluid under pressure is fed to the pipe through a flexible hose connected to this pipe. The valving member is fixed relative to the housing in one of the two positions by means of two pairs of stops made on the pipe and adapted to alternately embrace the flange, and by a spring-loaded ball stop element disposed in the flange and connected to a cable or rope. The flange also has longitudinal grooves for the passage of the pipe stops therethrough.

In order to reverse the forward percussive action of the machine, it is necessary to terminate the supply of fluid under pressure. Thereafter, by pulling the cable the ball of the ball stop is released from the socket. The flexible hose is then twisted to turn the pipe a certain angle for the stops to assume a position in registration with the longitudinal grooves of the flange. It is then necessary to pull on the flexible hose without releasing the tension applied to the cable and thereby move the pipe axially so as to have the front pair of stops disposed on the opposite sides of the flange, whereupon the pipe is again turned a certain angle so that the ball of the spring-loaded ball stop would be in alignment with the socket in the pipe.

The cable is then slackened and the pipe (and, therefore, the valving member) is fixed in place between the front pair of stops by the spring-loaded ball relative to the flange and the housing.

When the supply of fluid under pressure to the machine is resumed, the hammer will execute reciprocations inside the housing to deliver impacts on the rear (tail) end thereof to cause the machine to move back away from the hole made.

For a switchover to the forward percussive action the fluid valving member is displaced in the aforedescribed manner.

The above machine has inherent disadvantages due to its structural complexity, difficulties in handling, and unreliable reversal because to reverse the percussive action of the machine it is necessary to make several operations simultaneously involving manipulations of the cable (applying tension thereto) and the flexible hose (twisting and pulling the hose). It is consequently difficult for a single operator to do the reversal operation. In addition, attempts to twist the pipe in long holes made in a loose soil may fail altogether.

Another disadvantage of the above machine resides in the lack of a mechanism providing for automatically setting the machine for the forward percussive action. Therefore, the operations associated with starting the machine to perform the forward percussive action are made manually.

In addition, the aforedescribed prior art construction fails to provide for a swift reversal from the forward travel to backing (for example, in an emergency). Such a reversal requires, along with other manipulations, to move the pipe forward axially, which is normally impossible to make by the flexible hose.

There is also known a reversible percussive action machine (cf. West German Pat. No. 2,633,251, published Apr. 14, 1977) comprising a housing accommodating a hammer reciprocating under the action of a pressurized fluid to deliver impacts on a front end of the housing during the forward percussive action and on the rear end of the housing for backing the machine out of the hole, and a fluid valving member to control the distribution of the fluid movably connected to the hammer and provided with means for fixing the valving member relative to the housing in two positions, viz. for the forward and backward travel of the machine inside the hole. The means for fixing the fluid valving member to move the machine forward has the form of a spring-loaded elastic annular insert (pin) capable of displacement relative to the valving member, this pin being secured in a socket made in the side wall of the valving member and having a section adapted to respond to the pressure exerted by the fluid to come into engagement with the housing and thereby axially fix in place the fluid valving member relative to the housing. This means for fixing the valving member during backing of the machine has the form of a stop element provided on the inner wall of the housing and serving to cooperate with a stop provided on the fluid valving member.

The housing is axially spring-loaded relative to the fluid valving member to ensure displacement of the valving member from a position in which it distributes the fluid to cause the rearward percussive action to a position for the forward travel of the machine.

In order to set the valving member to the front position and thus assure the forward percussive action of the machine, it is necessary that a fluid under pressure be supplied along a flexible hose to the machine, which fluid would act to exert pressure on the surface of the insert (pin) facing the interior of a high-pressure fluid line and move the insert toward the housing. This causes the elastic element to be released, and the side surface of the insert tends to come into engagement with the stop element of the housing, whereby the fluid valving member is fixed in a position corresponding to the forward percussive action of the machine.

Subsequent to feeding the pressurized fluid, the hammer executes reciprocations inside the housing to deliver impacts on the forward end thereof for the machine to move ahead in the ground and leave a hole behind.

In order to reverse the percussive action of the machine, it is necessary to terminate the supply of fluid under pressure, whereby the annular elastic element acts to displace the insert to the socket of the valving member, be brought out of engagement with the axial stop of the housing and assume a position ensuring mobility of the valving member relative to the housing. By pulling the flexible hose the valving member is displaced axially of the housing until the stops of the valving member engage the stops of the housing for the element exerting a spring-loaded action on the valving member relative to the housing to be compressed. Thereafter, without releasing the pull force from the flexible hose, the pressurized fluid is fed therethrough to the machine to provide for an axial force to be exerted on the valving member and directed toward the rear portion or tail end of the housing. This axial force acts to fix the valving member in a position that ensures the rearward percussive action of the machine. In this position the valving member provides for reciprocating motions of the hammer in the housing to deliver impacts against the rear part (tail end) of the housing for the machine to move in the hole in a reverse direction or backwards.

For a repeated switchover of the machine to the forward percussive action the supply of the pressurized fluid must be terminated. The element which spring-loads the valving member, relative to the housing acts to move the valving member to its front position corresponding to the forward percussive action of the machine for this valving member to be fixed relative to the housing under the action of the fluid supplied under pressure in the aforedescribed manner and the apparatus to execute the forward percussive action.

However, the just described apparatus has a rather low reliability because the means for fixing the valving member is susceptible to failure because the force transmitted to the insert (pin) by the fluid under pressure to push the insert from the socket and determined by the product of the pressure of the fluid by the cross-sectional area of the insert (pin) is small. This force must, however, be greater than the force produced by the annular elastic element. In consequence, the force produced by the annular elastic element is still smaller, while the annular elastic element should feature relatively small but constant power characteristics. It is known, however, that annular elastic elements are difficult to fabricate and offer no such stable power characteristics. Therefore, when the annular elastic element has a greater than rated rigidity, the force of the pressurized fluid fails to expel the insert, and the valving member fails to be fixed relative to the housing to make the machine produce a forward percussive action.

Conversely, if the elastic element is not sufficiently rigid, the insert (pin) would fail to be forced back into the socket of the valving member, and the valving member would fail to be moved axially from the housing to be fixed in a position corresponding to the reverse percussive action of the machine.

In addition, the annular construction of the elastic element overcomplicates the machine in that it becomes larger in diameter, which affects its specific power.

This machine is of low reliability also because its parts and units are susceptible to damage; the most susceptible are the annular elastic element, the fluid member and the housing in the location where the insert is accommodated. The damage may be caused due to rigid transmission of impact loads from one part to another.

Further, the machine is disadvantageous in that the insert (pin) bears on the axial stop by its side cylindrical surface, which causes high contact stresses and may result in failure of the housing or the insert (pin).

SUMMARY OF THE INVENTION

It is an object of the present invention to improve the reliability of reversing the percussive action of the machine.

Another object is to improve the reliability of the machine as a whole.

One more object is to structurally simplify the reversible percussive action machine.

These objects and other attending advantages of the invention are attained by a reversible percussive action machine comprising a housing which accommodates a hammer capable of reciprocating motions under the action of a fluid under pressure to deliver impacts on a head end of the housing for the forward percussive action of the machine and on a tail end of the housing for the rearward percussive action of the machine, and a fluid valving member for controlling the distribution of the fluid under pressure movably connected to the hammer and provided with means for fixing it relative to the housing in two control positions; that is positions assuring the forward percussive action and rearward percussive action of the machine, the means for fixing the fluid valving member in the forward percussive action of the machine having the form of at least one spring-loaded insert slidably secured in a recess made in the side wall of the fluid valving member and having a section for taking up the pressure exerted by the pressurized fluid under which action the insert is brought into engagement with a stop of the housing to fix axially the fluid valving member relative to the housing, the means for fixing the valving member to ensure the rearward percussive action of the machine having the form of a stop made on the inner wall of the housing and a stop made on the valving member adapted to come into engagement with the stop of the housing, the housing being axially spring-loaded relative to the fluid valving member, according to the invention, the insert is fashioned as a cup facing by its bottom a pressurized fluid line, the cup accommodating an element which spring-loads the cup relative to the valving member.

Preferably, the element which spring-loads the cup relative to the valving member has the form of a spring and ball assembly, the ball bearing on the housing, or, alternatively, this element may have the form of a spring and cap assembly, the cap being adapted to enclose this spring and bear by its spherical surface on the housing.

Desirably, the height of the cup is greater than the wall thickness of the valving member at the location of the recess therein.

Alternatively, the side surface of the insert engageable with the stop of the housing during the forward percussive action of the machine is flat.

The invention therefore provides a reversible percussive action machine featuring a reliable fixation of the fluid valving member in its two extreme position relative to the housing. The machine per se is structurally simple to fabricate and reliable in operation.

The arrangement of the insert in the form of a cup and accommodation inside the cup of a spring-loaded element enables to further structurally simplify the machine and make it more reliable in operation. In addition, the cup-shaped arrangement of the insert affords to enlarge the diameter of the insert, that is to increase forces exertable thereon by the pressurized fluid, and increase the springing action of the spring-loaded element to thereby still greater guarantee the proper functioning of the means for fixing the fluid valving member.

It is to be noted that the cup-shaped configuration of the insert does not result in an increase in its weight, which again is favourable for the reliable functioning of the fluid valving member fixing means and operation of the machine, since a simple increase in the diameter of the insert entails an increase in its mass, whereby part of the force exerted thereon by the pressurized fluid and some force of the spring element would be consumed for overcoming the inertia of this mass, which is disadvantageous.

Further, the cup-shaped arrangement of the insert affords to reduce impact loads to which the adjacent or mating parts of the fluid valving member fixing means and the housing are subjected; in other words, the insert in this case acts as a shock-absorber, viz., it deforms radially during operation and thus damps the shocks imparted by one element to another.

The accommodation in the interior of the cup of the spring element makes the construction compact and simple.

The modified arrangement of the element urging the insert relative to the fluid valving member in the form of a coil spring and cap assembly, the cap bearing on the housing, structurally simplifies the means for fixing the valving member in position; such an assembly maintains its power characteristics although smaller size and provides a greater reliability in operation.

Another modification of the spring-loaded element in the form of a coil spring and a ball bearing on the housing is characterized by improved reliability of the machine due to preventing jamming of the ball in the cup. The height of the cup exceeding the wall thickness of the fluid valving member in the location where the recess is made in the wall of the valving member assures proper functioning of the valving member fixing means and the machine in general due to the height of the side surface of the insert which is extensive enough to slide into the recess at the moment when the insert retracts from the recess.

In contrast, when the cup has a height of less than the wall thickness of the valving member, the mating surface area of the insert and the valving member is considerably reduced to affect the reliability of the means for fixing the valving member when the insert retracts from the recess.

The flat side surface of the insert cooperating with the axial stop of the housing ensures still greater reliability of the machine, since contact loads between the cooperating surfaces of the insert and the axial stop of the housing are minimized (i.e., planar rather than line contact is provided).

DETAILED DESCRIPTION OF THE INVENTION

Figure 1:
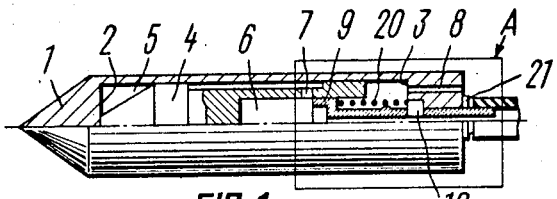
FIG. 1 is a partial cross-sectional view of a reversible percussive action machine.

With reference to FIG. 1 of the drawings, a reversible percussive action machine comprises a hollow housing 1 having a front part or head end 2 and a rear part or tail end 3, both ends being intended to take up impacts exerted by a hammer 4 disposed inside the housing 1 for reciprocations therein when acted upon by a fluid under pressure. In order to impart a forward travel to the machine, the hammer 4 delivers impacts on the front or head end 2 of the housing 1. Conversely, for the machine to back up or reverse its travel the hammer 4 delivers impacts on the rear or tail end 3 of the housing 1. The machine also comprises a system for distributing the fluid under pressure both for the forward and reverse percussive actions. This system includes a front working chamber 5 confined by an interior surface of the housing 1 and an exterior surface of the hammer 4, and a rear working chamber 6 confined by the interior of the hammer 4. The system further includes passages 7 to communicate the front and rear working chambers 5 and 6, respectively, and passages 8 provided in the housing 1 for the escape of the fluid outside. The machine also comprises a valving member 9 one end of which is movably connected to the hammer 4 and the other end is engageable with the housing 1. The fluid valving member 9 may assume two positions relative to the housing 1; in one (viz. front) position the valving member 9 controls the distribution of the fluid under pressure to provide for the forward travel of the machine, whereas in the second (viz. rear) position it functions in a similar manner to provide for reversal in the travel of the machine.

The valving member 9 has a means for fixing it in the position assuring a forward percussive action of the machine. This fixing means has the form of an insert 10 movable in the valving members 9 (FIGS. 2, 3, 4 and 5). When assuming a position for the forward percussive action of the machine, the insert 10 (FIG. 3) is brought into engagement with the housing 1 as seen best in FIG. 3, thereby fixing axially the valving member 9 relative to the housing 1. In a position for the reverse travel of the machine the insert 10 (FIG. 4) assures slidability of the valving member 9 relative to the housing 1 during switching of the machine for backing. The insert 10 (FIGS. 3 and 4) is secured in a recess 11 (FIG. 3) made in the wall of the valving member 9. The recess 11 is adapted to communicate with a pressurized fluid line by way of a central passage of the valving member 9 which is in turn communicated communicates with a fluid source (not shown) via a flexible pipe 12. The flexible pipe 12 is connected by one end thereof to the valving member 9 and by the other end to the pressurized fluid source.

The insert 10 has the form of a cup having a surface 13 (i.e., outer surface of the cup bottom) for taking up the force exerted by the fluid under pressure; a spring-loaded element being disposed inside the cup fashioned as a spring 14 and ball 15 urged by the spring to the housing 1.

Figure 6:
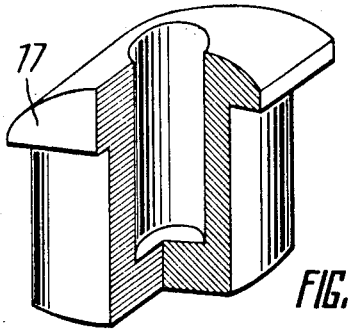
FIG. 6 is a partial cut-away view of a cup (insert).

Enagagement of the insert (cup) 10 with the housing 1 for the purpose of fixing the valving member 9 axially during the forward travel of the machine is ensured by a stop 16 made on the housing 1 and by a substantially flat surface 17 (FIG. 6) of the insert (cup) 10. The fluid valving member 9 is also provided with a means for fixing it axially to assure backward movement of the machine, this means having the form of a stop 18 (FIG. 4) made on the housing 1 and adapted for cooperation with a stop 19 of the valving member 9.

The machine according to the invention also has a compression spring 20 to spring-load the housing 1 in the axial direction and ensure that the valving member 9 moves to its front position to be fixed for providing the forward travel of the machine. At the tail end of the valving member 9 there is provided a rear stop 21 to limit axial displacement of the valving member 9 and intended to be brought into engagement with the end face of the housing 1.

An alternative embodiment of the percussive machine according to the invention envisages a spring-loaded element in the form of a spring 22 (FIG. 5) enclosed by a cap 23 bearing by its spherical surface on the housing 1.

The height of the insert (cup) 10 is greater than the wall thickness of the valving member 9 at the location of the recess 11.

The reversible percussive machine illustrated in FIGS. 1 to 5 employs one insert 10; however, more than one such insert 10 may be used for the sake of making the machine according to the invention more reliable in operation.

The reversible percussive machine according to the invention operates as follows.

Figure 2:
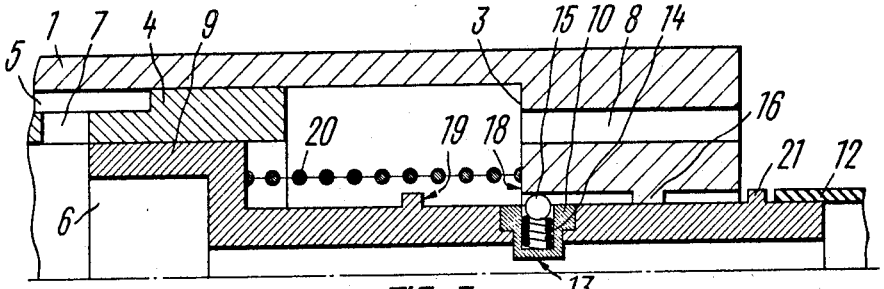
FIG. 2 is an enlarged view of a section A in FIG. 1 illustrating a position of the reversible percussive action machine prior to feeding a fluid into it.

FIGS. 1 and 2 show the machine in its initial position, when the pressurized fluid source is cut off therefrom. When the supply of the fluid is initiated, it is delivered along the flexible pipe 12, working chamber 6 and passage 7 to the front working chamber 5. Under the action of the pressure of fluid in the rear working chamber 6 the valving member 9 is caused to move rearwardly (toward the tail end 3 of the housing 1) to compress the spring 20. Concurrently, the fluid acts on the surface 13 of the insert (cup) 10 for the latter to move in the recess 11 of the fluid valving member 9 toward the housing 1 and bear by its flat surface 17 on the stop 16 of the housing 1, whereby the valving member 9 is fixed in position relative to the housing 1. The force of the spring 14 must be selected so as not to hamper the travel of the insert (cup) 10 under the action of the fluid in the recess 11 of the valving member 9, the spring 14 being therefore compressed.

Figure 3:
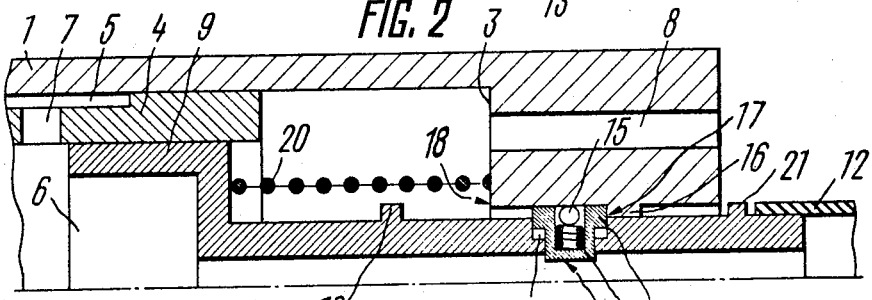
FIG. 3 is an enlarged view of a section A in FIG. 1 illustrating a position of the machine while executing a forward percussive action.

The new position of the parts and elements of the machine for the forward percussive action subsequent to feeding the fluid under pressure thereto is illustrated in FIG. 3.

In the course of the forward percussive action of the machine the pressurized fluid occupying the front and rear working chambers 5 and 6, respectively, acts to make the hammer 7 execute reciprocations inside the housing 1 and deliver impacts against the head end 2 of the housing 1. Under the action of these impacts the machine moves ahead leaving a wall behind. The fluid under pressure is conveyed to the front chamber 5 through the passage 7 and escapes therefrom through the passages 7 and 8.

In order to reverse the travel of the machine, it is necessary to terminate the supply of the pressurized fluid. Thereafter, the compression spring 20 will act to force the valving member 20 forward to the head end 2 of the machine. The insert (cup) 10 will be displaced by the force of the spring 14 toward the recess 11 of the valving member 9 to assume a position shown in FIG. 2. The rear stop 21 of the valving member 9 will be brought into engagement with the housing 1 to thus limit the axial displacement of the valving member 9.

It is then necessary to pull the flexible pipe 12 with a force greater than the force of the compression spring 20. The valving member 9 would thus be moved rearwards to the tail end 3 of the housing 1 (see cf. FIG. 4) until the front stop 18 of the housing 1 and the stop 19 of the valving member 9 are in engagement. Therewith, the ball 15 (FIG. 4) or the cap 23 (FIG. 5) will be forced by the stop 16 of the housing 1 into the interior of the insert (cup) 10 to compress the spring 14 or 22 (FIG. 5).

Figure 4:
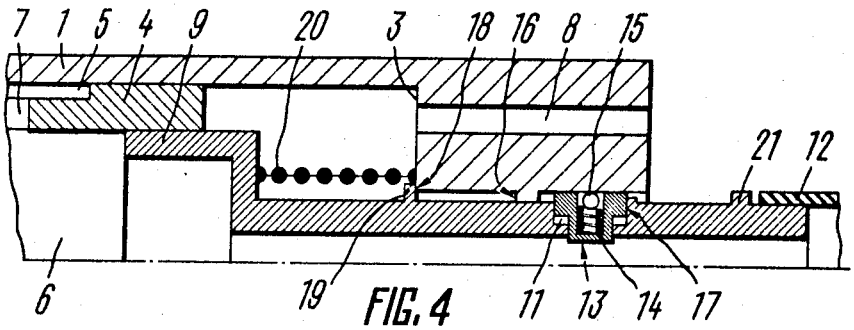
FIG. 4 is an enlarged view of section A in FIG. 1 illustrating a position of the machine during backing up.
Figure 5:
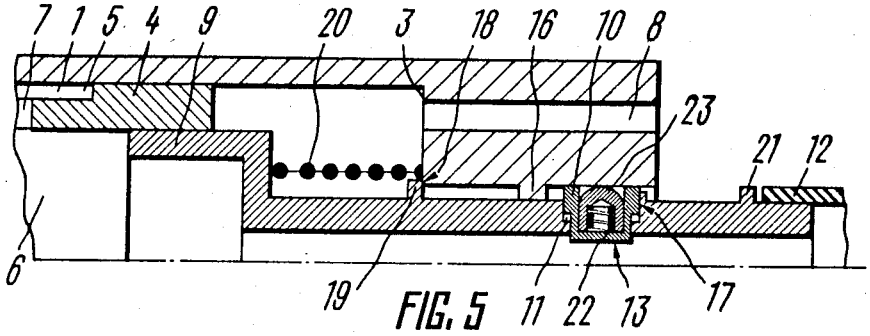
FIG. 5 illustrates another embodiment of Section A in FIG. 4 with a spring-loaded element in the form of a spring and cap assembly.

This new position of the parts and elements of the machine are shown in FIGS. 4 and 5, whereby the machine would be capable of backing up.

Thereupon, without releasing the pull force on the flexible pipe 12, the fluid under pressure is to be supplied to the working chambers 5 and 6 of the machine.

Under the action of the fluid in the working chambers 5 and 6 the hammer 4 will resume reciprocations in the housing 1.

By virtue of the fact that the valving member 9 assumes a new position in which it is displaced axially of the machine toward the tail end 3 of the housing 1, the intake of the fluid under pressure through the passage 7 to the front working chamber 5 occurs in time earlier, and the escape of the fluid from the working chamber 5 through the passages 7 and 8 occurs later, whereby the hammer 4 delivers impacts on the tail end 3 of the housing 1.

Under the action of these impacts the housing 1 and the machine are moved backwards along the well that has already been made to the location in the wall where the machine operation was initially started.

A repeated switchover of the machine for the forward percussive action is done automatically subsequent to terminating the supply of the fluid under pressure to the machine. In such an event, the compression spring 20, as seen best in FIG. 2, acts again to move the valving member 9 to its forward position until the rear stop 21 of the valving member 9 is brought in contact with the housing 1. After the fluid under pressure is fed as heretofore described, the parts and elements of the machine will assume a position represented in FIG. 3 for the machine to travel forward.

What is claimed is:

1. A reversible percussive action machine comprising: a housing; a hammer accommodated inside said housing and reciprocating within said housing by means of a pressurized fluid; a system for distributing said pressurized fluid to effect said reciprocations of said hammer to permit the hammer to deliver impacts on a head end of said housing to execute a forward percussive action of the machine and on a tail end of said housing to provide for a rearward percussive action of the machine; a fluid valving member of said fluid distribution system disposed in said housing and movably connected to said hammer, said fluid valving member having at least one recess on one side wall; a means for fixing said fluid valving member in a first position relative to said housing ensuring the forward percussive action of the machine and in a second position ensuring a rearward percussive action of the machine, said means having at least one cup-shaped insert moveably arranged relative to said fluid valving member and being equal in number to the number of said recesses in said side wall of said fluid valving member, said cup-shaped insert being mounted in a respective recess and having a depth dimension greater than a wall thickness measurement of said fluid valving member whereby a substantially integral bottom side of said insert facing a longitudinal center line of said housing and extending at least into a central passage of said fluid valving member is being acted upon by a force exerted by said pressurized fluid causing displacement of said insert along an axis of symmetry of said machine; a first stop of said means for fixing said fluid valving member in said machine attached to one end of said fluid valving member engaging said inserts; a second stop of said means for fixing said fluid valving member in said machine attached to a second end of said fluid valving member engaging said first stop; a spring-loaded element located in said cup-shaped inserts and positioning said inserts relative to said fluid valving member; and a compression spring located above said fluid valving member in said housing and used to axially spring-load said fluid valving member in said first position and said second position relative to said housing.

2. A reversible percussive action machine according to claim 1, wherein said spring-loaded element is a spring and ball assembly having the ball pressed against the housing by an action of the spring.

3. A reversible percussive action machine according to claim 1, wherein said spring-loaded element is a spring and cap assembly having the cap bearing by a spherical surface of said cap pressed against the housing.

4. A reversible percussive action machine according to claim 1, wherein said side surface of said inserts engaged with said first stop during the forward percussive action of the machine is flat.

* * * * *